US009217293B1

(12) United States Patent
Blum et al.

(10) Patent No.: US 9,217,293 B1
(45) Date of Patent: Dec. 22, 2015

(54) REVERSIBLE DISPLACEMENT AUGER TOOL

(71) Applicant: Berkel & Company Contractors, Inc., Bonner Springs, KS (US)

(72) Inventors: Kenneth J. Blum, Shawnee, KS (US); Brian R. Zuckerman, San Francisco, CA (US)

(73) Assignee: Berkel & Company Contractors, Inc., Bonner Springs, KS (US)

( * ) Notice: Subject to any disclaimer, the term of this patent is extended or adjusted under 35 U.S.C. 154(b) by 0 days.

(21) Appl. No.: 14/809,191

(22) Filed: Jul. 25, 2015

Related U.S. Application Data

(63) Continuation of application No. 14/516,646, filed on Oct. 17, 2014.

(51) Int. Cl.
*E21B 10/44* (2006.01)
*E21B 7/02* (2006.01)
*E21B 7/00* (2006.01)

(52) U.S. Cl.
CPC . *E21B 10/44* (2013.01); *E21B 7/00* (2013.01); *E21B 7/02* (2013.01)

(58) Field of Classification Search
CPC ..... E21B 10/44; E21B 7/201; E21B 7/005; E21B 17/22; E21B 7/20
See application file for complete search history.

(56) References Cited

U.S. PATENT DOCUMENTS 4,406,500 A 9/1983 Treuhaft et al.
4,966,498 A 10/1990 Blum (Continued)

FOREIGN PATENT DOCUMENTS

EP 371533 3/1992
EP 1519000 3/2005

(Continued)

OTHER PUBLICATIONS

"Continuous Flight Auger Piles", http://www.trevispa.eu/viewdoc.asp?co_id=172 (Accessed Jun. 16, 2015).

*Primary Examiner* — Brad Harcourt
(74) *Attorney, Agent, or Firm* — Hovey Williams LLP

(57) ABSTRACT

An auger assembly designed for creation of bores at sites where solid earth has a layer of loose overburden comprising an elongated auger shaft presenting a working end, with outwardly extending, helical flighting along at least a portion of the length of the shaft. Apparatus proximal to the working end is operable to compress the loose material as the auger assembly is rotated in a first direction, and preferably is in the form of arcuate rake structure above the working end; the auger serves to compress the loose material during rotation in the first direction until the solid earth is encountered, whereupon the auger assembly is rotated in the opposite direction to form the bore within the solid earth. The auger assembly preferably includes an upper auger section and a detachably secured lower auger bit assembly. The auger assembly is particularly useful in the formation of cast-in-place cementious piles.

5 Claims, 3 Drawing Sheets

(56) References Cited

U.S. PATENT DOCUMENTS

| | | | |
|---|---|---|---|
| 5,803,184 | A | 9/1998 | Van der Wouden |
| 7,357,199 | B2 | 4/2008 | Pedrelli |
| 7,546,887 | B2 | 6/2009 | Schwab |
| 7,669,673 | B1 | 3/2010 | Matthias et al. |
| 8,443,918 | B2 | 5/2013 | Massari |
| 8,500,370 | B2 | 8/2013 | Ditillo |
| 8,511,941 | B2 | 8/2013 | Curic et al. |
| 8,926,228 | B2 | 1/2015 | Stroyer |
| 2005/0167159 | A1 | 8/2005 | Bailey et al. |
| 2008/0131211 | A1 | 6/2008 | NeSmith et al. |

FOREIGN PATENT DOCUMENTS

| | | |
|---|---|---|
| EP | 2156907 | 2/2010 |
| GB | 2329204 | 3/1999 |
| WO | 2015026146 | 2/2015 |

REVERSIBLE DISPLACEMENT AUGER TOOL

CROSS-REFERENCE TO RELATED APPLICATION

This application is a continuation of application Ser. No. 14/516,646, filed Oct. 17, 2014, which is incorporated herein by reference in its entirety.

BACKGROUND OF THE INVENTION

1. Field of the Invention

The present invention is broadly concerned with overall auger assemblies and methods useful for the creation of bores at sites where solid earth has a layer of loose overburden, so as to quickly and inexpensively form such bores, especially during the fabrication of cast-in-place pilings. More particularly, the invention concerns such auger assemblies, as well as specialized auger bit assemblies forming a part of the overall augers, wherein apparatus is provided adjacent the working end of the auger or bit assembly which is operable to compress the loose overburden material in order to form a self-sustaining, compressed peripheral annulus of the material. Such apparatus preferably includes an arcuate rake above the working end of the auger or bit assembly.

2. Description of the Prior Art

One favored method of forming structural piles is through the use of auger pressure grouting techniques. During such operations, an upright metallic support frame is positioned adjacent a pile site and is supported by means of a mobile crane. An auger assembly is associated with the support frame, and includes an elongated, flighted auger having a hollow central shaft, as well as an upper auger motor. A supply of fluid grout is also provided, typically by means of a mobile grout truck, with the grout supply being connected to the auger shaft through a flexible hose. During pile-forming operations, the auger is first shifted downwardly during rotation thereof, so as to screw the auger into the earth. When the auger has reached a desired depth, the auger is withdrawn in order to remove the spoil. Simultaneously, fluid grout is directed under pressure through the auger shaft so as to create the pile.

While this technique is extremely advantageous when creating piles in virgin soil, problems may arise if the overburden in question is loose or of low density. For example, in certain areas of the country landfill sites have been largely exhausted, and is now desired to create waste disposal plants on those sites. Unfortunately, many such landfill sites have a low density overburden consisting of previously deposited municipal solid wastes. In such cases attempts at using the straightforward pile-forming technique described above may lead to excessive consumption of grout, in that as the grout is fed under pressure through the auger shaft, it spreads laterally outwardly through the overburden rather than creating a unified, upright pile.

One response to these difficulties is to employ an upright, tubular metallic casing to confine the grout. This expedient is generally known in the art, and methods have evolved for efficiently placing such casings in the earth. However, it has been discovered that use of casings is not a complete answer to the problem of forming piles in landfill sites, because the piles tend to uproot or turn during the pile-forming operations when the auger moves upwardly and downwardly therein. This problem is particularly acute when use is made of lower cost corrugated metallic, as opposed to the more expensive, heavy metallic straight tubes.

U.S. Pat. No. 4,966,498 describes another technique for dealing with the problem of loose overburden bore sites. The '498 patent describes use of a tubular collar inserted into the loose overburden, with a specialized gripping structure to hold the collar in place. While these techniques are quite useful, they can be relatively expensive owing to the need to use the specialized collar and gripper structure.

General design considerations for auger assemblies used in the fabrication of cast-in-place pilings are described at https://www.fhwa.dot.gov/engineering/geotech/pubs/gec8/gec8.pdf.

SUMMARY OF THE INVENTION

The problems outlined above are addressed by the present invention, which provides an auger assembly operable to create a bore where solid earth has a layer of loose overburden. The auger assembly comprises an elongated, auger shaft presenting a working end, as well as outwardly extending, helical flighting along at least a portion of the length of the shaft. The auger assembly further has apparatus proximal to the working end and operable to compress the loose material, such apparatus comprising a rake extending outwardly toward the periphery of the flighting and positioned above the working end of the auger assembly. The rake is oriented to engage the loose material during rotation of the auger shaft in a first direction, and to compact the loose material in the region adjacent the flighting periphery. The shaft is also rotatable in a second direction opposite the first direction after compaction of the loose overburden in order to cause the working end to engage solid earth so as to create the bore.

In preferred forms the rake presents a surface which leads the adjacent portion of the flighting during rotation of the auger shaft in the first direction, and the surface trailing the adjacent flighting portion during rotation of the auger shaft in the second direction. The rake normally has a pair of opposed rake sections, each rake section being secured to the shaft and to the corresponding outer peripheries of the adjacent flighting portion. Furthermore, the rake sections are preferably arcuate between the shaft and the corresponding outer peripheries.

The working end of the auger assembly comprises a plurality of earth-engaging teeth, typically lowermost pilot teeth with a plurality of secondary teeth located above and outwardly of the pilot teeth.

The auger shaft is preferably hollow and is operable to receive grout for delivery into the bore as the auger is withdrawn, thereby permitting formation of cast-in-place piles.

The overall auger assembly preferably includes an elongated auger section with a lower auger bit assembly secured to the auger section and defining the working end of the auger assembly. The auger bit assembly includes an elongated, tubular stem, which is communication with the hollow auger section shaft and has a pair of helical flights along the length of the stem. Connection structure is provided for detachably securing the stem to the auger section, to create the complete auger assembly.

The invention also provides methods of creating elongated bores at bore sites having loose overburden material above solid earth. These methods comprise the steps of rotating an auger assembly in a first direction through the loose overburden material until solid earth is encountered, and, during the auger assembly rotation in the first direction, creating an annulus of compressed material about the periphery of the auger assembly. When the solid earth is encountered, the auger assembly is rotated in a second direction opposite to the first direction, and a bore into the solid earth is formed below the loose overburden material. Thereafter, cementious material is injected into the bore and within the annulus through the auger assembly to create a pile.

DETAILED DESCRIPTION OF THE PREFERRED EMBODIMENT

Figure 1:
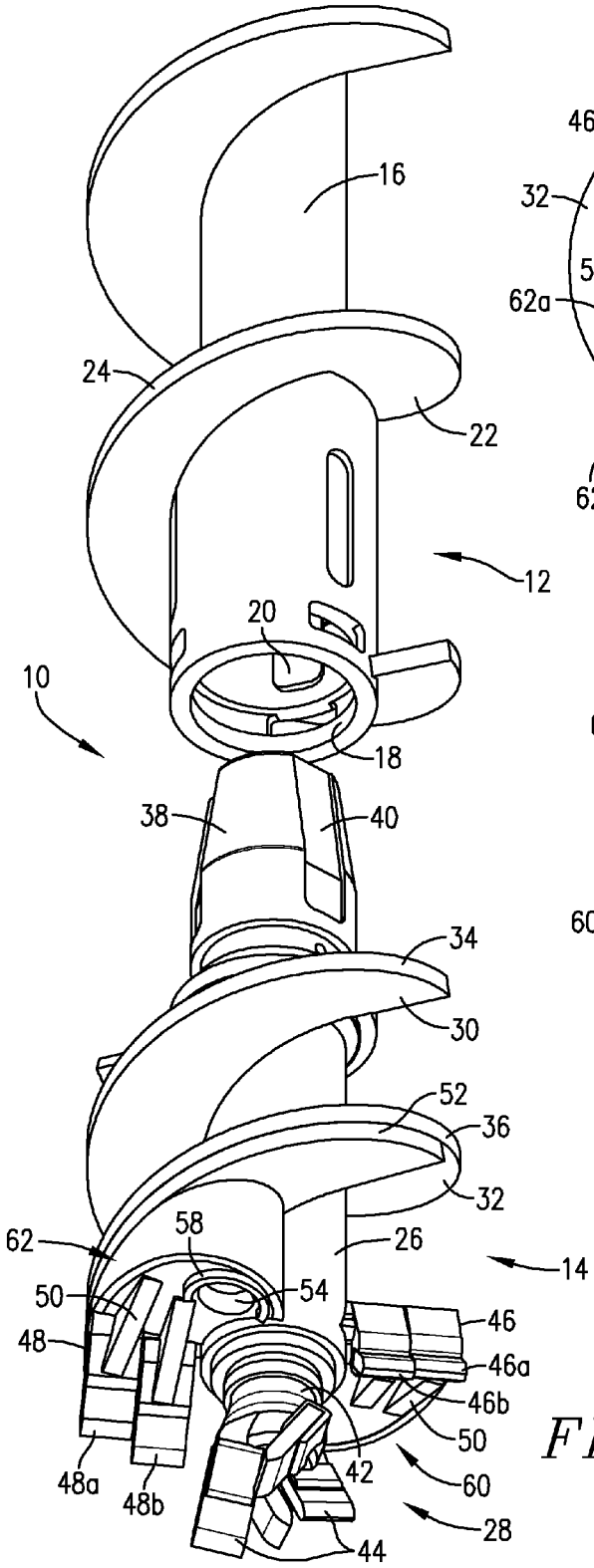
FIG. 1 is an exploded perspective view illustrating a continuous flight auger and an auger bit assembly in accordance with the invention.

Turning now to the drawings, an overall auger assembly 10 in accordance with the invention is illustrated in FIG. 1 and generally includes an elongated auger section 12 and a lowermost auger bit assembly 14. FIG. 1 illustrates the section 12 and assembly 14 in an exploded relation, but it will be understood that the assembly 14 is operably coupled with section 12 to provide an overall, complete auger assembly 10 designed to create elongated bores in the earth, and particularly where the bore site has loose overburden above solid earth. Such bores are typically created as a part of formation of structural piles where grout or other cementious material is delivered through the auger assembly as it is retracted from the bore.

In more detail, the auger section 12 includes an elongated, tubular, primary shaft 16 having a lowermost open end 18 equipped with three circumferentially spaced apart connection keys 20. A single auger flight 22 is secured to the shaft 16 and extends outwardly therefrom to define a flighting periphery 24. In normal operation, the auger assembly 10 is supported above-grade by a mobile crane or other device, and an auger motor is operably coupled with the upper end of the assembly 10 for rotation thereof.

The bit assembly 14 includes a central, tubular stem 26 presenting a working end 28, as well as a pair of auger flights 30 and 32. Each of the flights 30, 32 extends substantially a full 360° convolution about stem 26 and also define corresponding flighting peripheries 34 and 36. The upper end of stem 26 is equipped with an elongated, tapered connector 38 provided with three circumferentially spaced apart keyways 40. As is readily apparent from an understanding of FIG. 1, the connector 38 is designed to extend into the open end 18 of shaft 16, with the keyways 40 interfitting with keys 20, so that the assembly 14 may be securely interfitted with the section 10. The flight 30 of assembly 14 comes into abutment with the end of flight 22 when the assembly 14 is properly coupled with section 12.

The working end 28 of assembly 14 includes a central, downwardly and axially extending pilot segment 42 secured to stem 26 and supporting four spaced apart earth-engaging pilot teeth 44. In addition, the end 28 has two pairs of upper earth-engaging teeth 46 and 48 connected to corresponding portions of the flights 30, 32. Each such pair includes two side-by-side teeth 46*a*, 46*b* and 48*a*, 48*b*, and each such tooth further has a reinforcing gusset 50 (see FIGS. 1 and 2). A helical auger-reinforcing plate 52 is secured to the underside of flights 30, 32 and extends along the flights substantially 90°.

Figure 2:
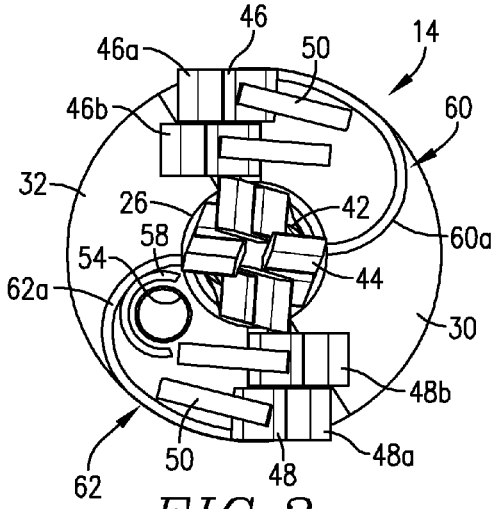
FIG. 2 is an end view of the working end of the bit assembly illustrated in FIG. 1.
Figure 6:
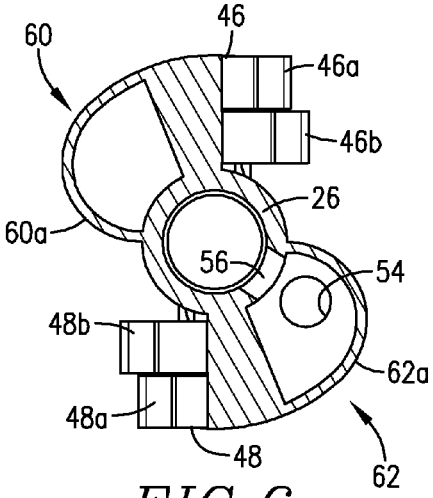
FIG. 6 is a sectional view taken along the line 6-6 of FIG. 4.
Figure 3:
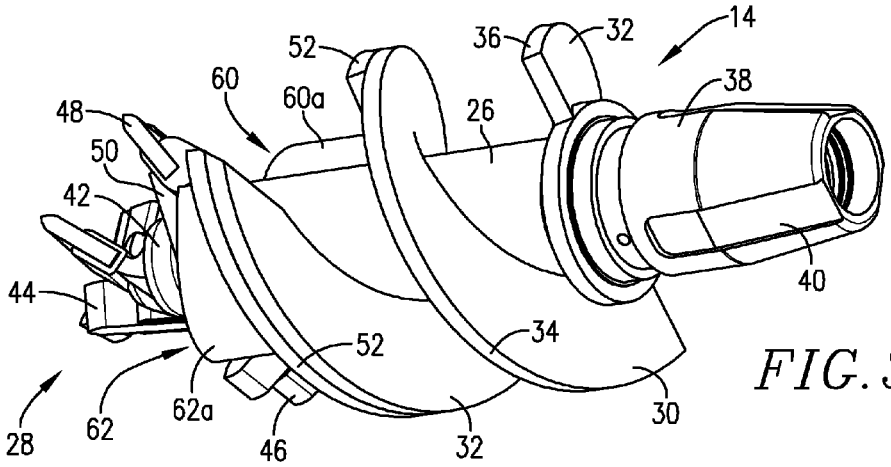
FIG. 3 is a perspective view of the auger bit assembly viewing from the connector end thereof.
Figure 4:
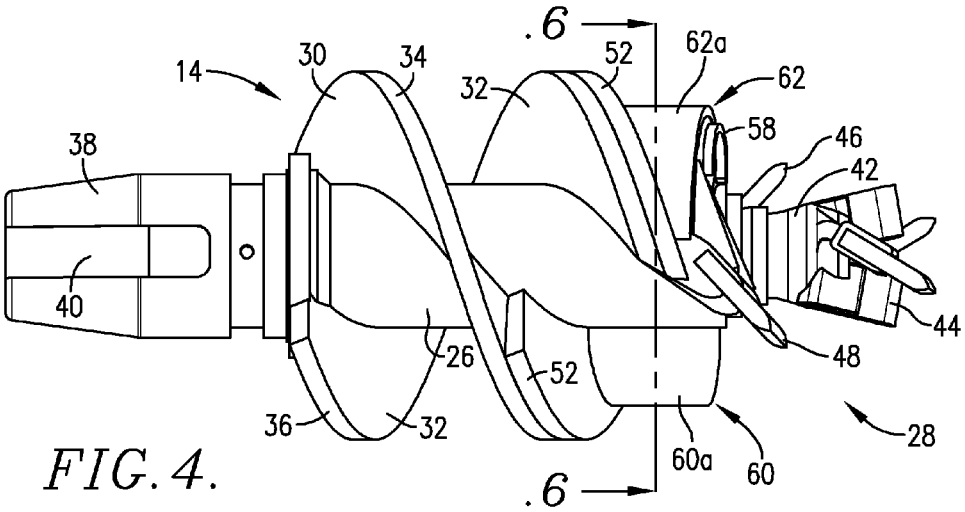
FIG. 4 is an elevational view of the auger bit assembly.
Figure 5:
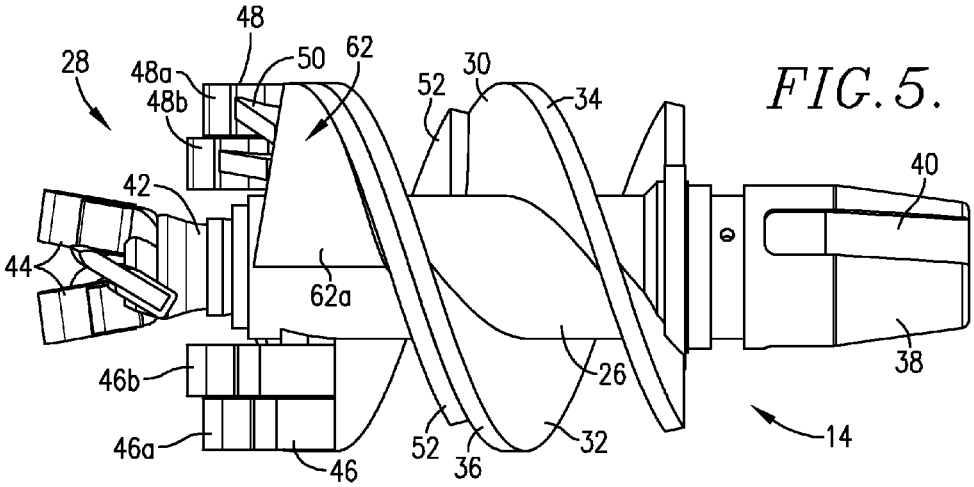
FIG. 5 is another elevation view of the auger bit assembly, illustrating the bit assembly rotated 90° as compared with the illustration of FIG. 4.

As best in FIGS. 2 and 6, the lower end of flight 32 and rake 62 is equipped with a "cork hole" 54, which is normally filled with a releasable plug (not shown) during creation of a bore. In addition, the stem 26 has a side passageway 56 above the cork hole 54. Finally, an arcuate protector 58 is secured to the flight adjacent the undersigned of cork hole 54 in order to prevent dislodgement of the plug during creation of the bore.

The overall bit assembly 14 further has apparatus designed to deal with loose overburden at the bore site. To this end, a pair of arcuate, oppositely outwardly extending rakes 60, 62 are secured to the stem 26 and to the flights 30, 32. Each rake thus presents an arcuate leading surface 60*a*, 62*a* located above the teeth pairs 46, 48, when the assembly 14 is rotated in a first direction; however, when the stem assembly 14 is rotated in the opposite direction, the rakes 60, 62 become followers.

Figure 7:
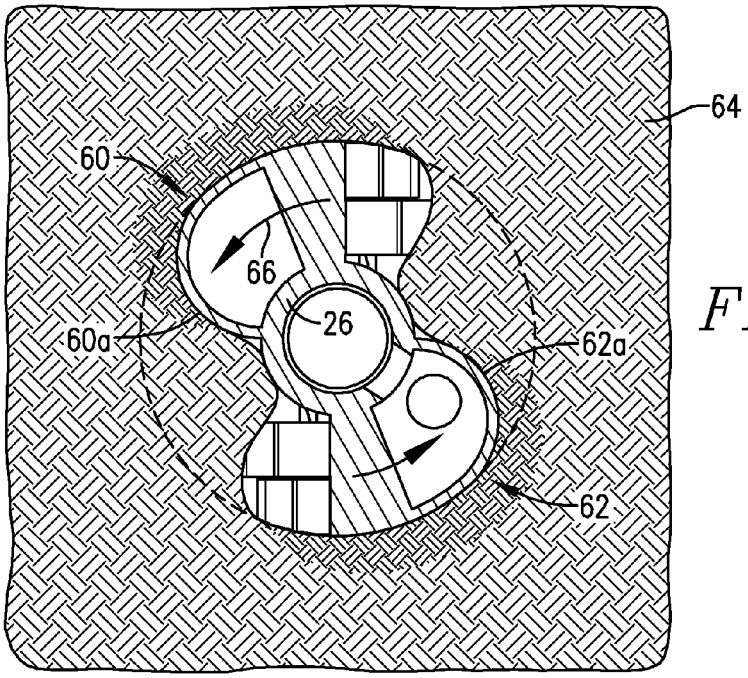
FIG. 7 is a fragmentary view illustrating the operation of the auger bit assembly during initial stages of compaction of loose overburden during fabrication of a piling.
Figure 8:
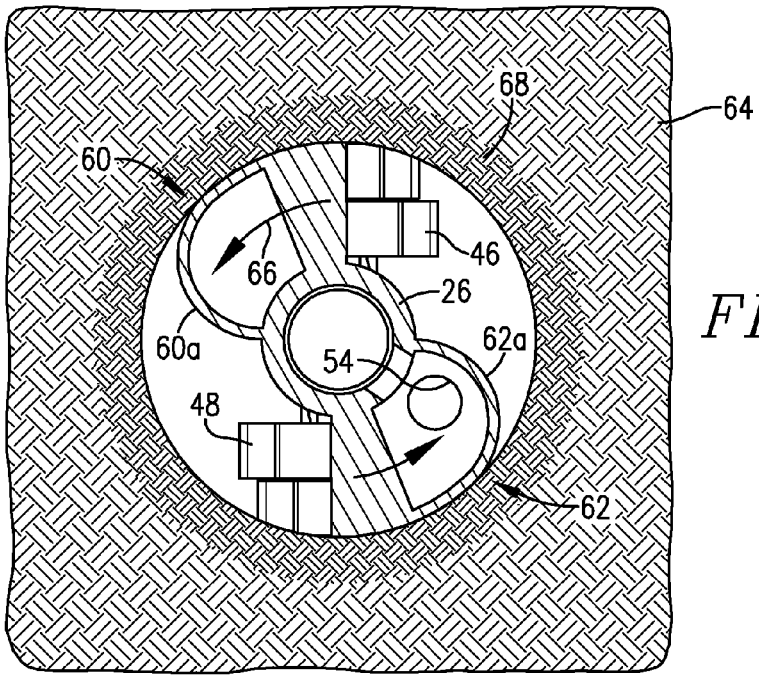
FIG. 8 is a view similar to that of FIG. 7, but depicting formation of a complete annulus of compacted overburden, prior to the commencement of augering solid earth below the overburden.

As noted previously, the invention is particularly designed for creating bores in situations where the bore sites have significant quantities of loose overburden above solid soil. This operation is best illustrate in FIGS. 7 and 8, where it will be seen that loose overburden 64 is present. As illustrated in FIG. 7, when the auger assembly 10 (and thereby auger bit assembly 14) is rotated in a counterclockwise as illustrated by arrows 66, the leading surfaces 60*a* and 62*a* of the rakes 60 and 62 serve to propel and move the overburden radially outwardly relative to the outer peripheries of the flights 30, 32, and 22. As this action proceeds, a compacted annulus 68 of the loose overburden is formed about the periphery of the bore hole and just outboard of the flighting peripheries.

This operation proceeds through the depth of the overburden 64, until solid soil is encountered, which is readily apparent owing to the increase torque required for drilling through the solid soil. At this point, the auger assembly 10 is rotated in the opposite, clockwise direction so that the working end 28 begins to create the bore in the solid earth. It will be observed that during such rotation in the second direction, the rakes 60, 62 are simply followers and have no substantial functional effect.

Once the bore is completed to the desired depth, the auger is withdrawn from the bore while continuing to rotate, so as to deliver material from the bore to the surface. At the same time, pressurized grout is delivered through shaft 16 and stem 26, in order to dislodge the plug from cork hole 54, thereby facilitating flow of the grout into the bore; such pressurized grout is then delivered throughout the withdrawal of the auger, in order to fill the bore.

Preferably, the annulus formed during augering through the loose overburden is of sufficient density to be substantially self-sustaining throughout its length, thereby forming a tubular column. As such, the grout fills the bore through the solid earth, and extends upwardly to grade without undue dispersion of the grout outwardly beyond the compacted annulus.

We claim:

1. A method of creating an elongated bore at a bore site having loose overburden material above solid earth, said method comprising the steps of:

rotating an auger assembly in a first direction through said loose overburden material until said solid earth is encountered, and, during said auger assembly rotation in said first direction, creating an annulus of compacted material about a periphery of the auger assembly; and when said solid earth is encountered, rotating said auger assembly in a second direction opposite to said first direction, and forming a bore into the solid earth below the loose overburden material.

2. The method of claim 1, said annulus-creating step comprising the step of moving said loose overburden material radially outwardly during rotation of the auger assembly in said first direction.

3. The method of claim 1, said auger assembly comprising a shaft with helical flighting secured to said shaft along at least a portion of the length of said shaft, and a working end, including the step of using a rake assembly secured to said auger assembly above said working end thereof to move said overburden radially outwardly.

4. The method of claim 3, said rake assembly extending outwardly toward the periphery of said flighting and positioned above the working end of the auger assembly, said rake assembly being symmetrical relative to said augur shaft and oriented to engage said loose material during rotation of the auger shaft in a first direction, and to compact the loose material in the region adjacent said flighting periphery.

5. The method of claim 3, said rake assembly having a pair of opposed rake sections extending outwardly from a point adjacent said shaft toward the periphery of said flighting and positioned above the working end of the auger assembly, each rake section presenting an arcuate surface extending in a direction opposite to that of the arcuate surface of the other rake section, said rake assembly oriented to engage said loose material during rotation of the auger shaft in a first direction, and to compact the loose material in the region adjacent said flighting periphery.

* * * * *